United States Patent [19]

Ohmukai et al.

[11] 4,229,159

[45] Oct. 21, 1980

[54] COMBUSTION DEVICE FOR LIQUID FUELS

[75] Inventors: Yoshimi Ohmukai, Hirakata; Takeshi Tomisawa, Katana; Yoshitaka Kawasaki, Nara, all of Japan

[73] Assignee: Matsushita Electric Industrial Co., Ltd., Osaka, Japan

[21] Appl. No.: 969,555

[22] Filed: Dec. 14, 1978

[30] Foreign Application Priority Data

| | | | |
|---|---|---|---|
| Dec. 20, 1977 | [JP] | Japan | 52/154015 |
| Feb. 27, 1978 | [JP] | Japan | 53/1022643 |
| Mar. 10, 1978 | [JP] | Japan | 53/028152 |
| Mar. 16, 1978 | [JP] | Japan | 53/030684 |

[51] Int. Cl.[3] ..... F23D 13/12

[52] U.S. Cl. ..... 431/328; 431/341; 431/342

[58] Field of Search ..... 431/328, 341, 342, 300

[56] References Cited

U.S. PATENT DOCUMENTS

| | | | |
|---|---|---|---|
| 3,810,732 | 5/1974 | Koch | 431/328 |
| 3,870,459 | 3/1975 | Desty et al. | 431/328 |
| 3,912,443 | 10/1975 | Ravault et al. | 431/328 |
| 3,923,447 | 12/1975 | Desty et al. | 431/328 |
| 4,047,876 | 9/1977 | Rice | 431/328 |

*Primary Examiner*—Joseph Man-Fu Moy

*Attorney, Agent, or Firm*—Joseph W. Farley

[57] ABSTRACT

A device which includes a porous burner head capable of containing a liquid fuel in a liquid state and in which air is supplied to the surface of the burner head to vaporize and burn the fuel contained therein. The burner head is made of a heat-resistant porous material having extending therethrough minute channels which are predominantly up to 100 μm in diameter and give the burner head a porosity of at least 25%. The burner head is capable of raising the liquid fuel at a rate of at least 0.001 g/cm$^2$.min to a height of up to 70 mm. The use of the burner head assures clean combustion and high combustion efficiency.

11 Claims, No Drawings

COMBUSTION DEVICE FOR LIQUID FUELS

The present invention relates to a combustion device for liquid fuels, and more particularly to such a device which gives a steplessly variable calorific value and which achieves a high combustion efficiency with a clean exhaust gas at all times despite the variations in the calorific value.

To achieve an ideal combustion efficiency with a clean exhaust gas containing a reduced amount of carbon monoxide or soot and to thereby assure a high heat exchange efficiency, it is desirable to maintain a constant excess air factor as is widely known. When the calorific value is varied steplessly, however, it is extremely difficult, and in fact infeasible, to maintain a substantially constant excess air factor notwithstanding the variations in the calorific value.

Liquid fuel combustion devices heretofore known are of the gun type, pot type, wick type, etc. With these devices, the calorific value is controlled by varying the fuel supply to the burning portion. The control of the calorific value greatly alters the excess air factor, consequently impairing the state of combustion, giving increased quantities of carbon monoxide and other toxic emissions, producing a larger amount of soot to clog the exhaust gas passage or cause pollution, leading to a reduced heat efficiency, or possibly rendering the device inoperative. These are problems heretofore encountered.

The main object of this invention is to overcome the above problems and to provide a liquid fuel combustion device which gives a steplessly variable calorific value over a wide range while permitting clean combustion with an improved efficiency as well as with inhibited formation of carbon monoxide or soot.

A preferred embodiment of this invention includes a fuel vaporizing portion which is free of the accumulation of a tarlike substance, thus enabling the device to maintain a high combustion efficiency over a prolonged period of time.

Another preferred embodiment of the invention assures stabilized combustion even in the range of low calorific values.

The preferred embodiments of this invention will be described below in greater detail with reference to the accompanying drawings, in which.

Figure 1:
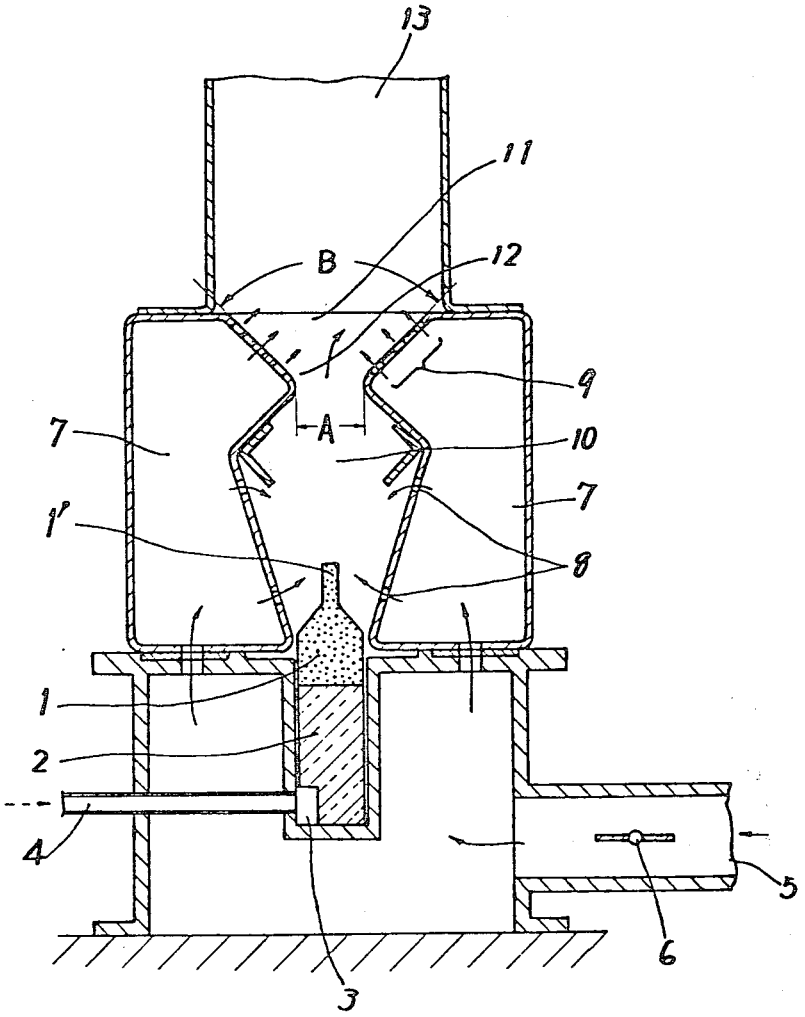
FIG. 1 is a fragmentary sectional view showing a liquid fuel combustion device in a horizontally elongated shape embodying the invention.

With reference to FIG. 1, a burner head 1 made of a heat-resistant porous material has a fuel vaporizing portion 1' at its upper portion. The burner head has minute channels extending therethrough. An absorbing member 2 used as an example of part of a fuel feeder has a lower end in contact with a liquid fuel in a fuel supply channel 3 and an upper end in contact with the burner head 1 to feed the fuel to the head. A fuel supply conduit 4 provides a passage for supplying the fuel to the channel 3. With this embodiment, the liquid fuel is supplied from a fuel tank (not shown) to the channel 3 by gravity or by a pump or like means (not shown) and then lead to the fuel vaporizing portion 1' by the capillary action of the burner head 1. The fuel feeder including the unillustrated fuel tank, pump or like means must be adapted for variations in the calorific value, such that at a low calorific value, for example, an excess of the fuel will not overflow into an undesired portion or outside. For this purpose, for example, the fuel feeder may be designed to supply the fuel at a rate corresponding to a maximum calorific value, with an excess of the fuel, if any, adapted to return to the fuel tank. Various other arrangement will be useful.

FIG. 1 further shows an air supply conduit 5, an air flow regulator 6, a pair of opposite air chambers 7, primary combustion air passages 8 each comprising a plurality of ports for keeping the air chambers 7 in communication with a primary combustion chamber 10, and secondary combustion air passages 9 each comprising a plurality of ports for permitting the air chambers 7 to communicate with a secondary combustion chamber 11. By these means air is dividedly supplied to the combustion chambers 10 and 11. The air is introduced into the device by an unillustrated blower at a desired flow rate adjusted by the regulator 6 and then dividedly fed to the primary combustion chamber 10 and the secondary combustion chamber 11.

The rates of the divided air flows into the primary combustion chamber 10 and the secondary combustion chamber 11 are determined by the shape, dimension and position of the primary and secondary combustion air passages 8 and 9.

Indicated at 12 is a constricted portion provided at the junction between the primary combustion chamber 10 and the secondary combustion chamber 11, and at 13 an exhaust gas passage.

The solid-line arrows in FIG. 1 indicate the directions in the air supply flows, and the broken-line arrow shows the direction in which the fuel is supplied.

With the construction described above, the overall calorific value is controllable by adjusting the flow of the primary combustion air. Stated more specifically the rate of vaporization of the liquid fuel is substantially in proportion to the difference between the vapor pressure of the liquid fuel and the vapor pressure of the gas phase adjacent the fuel vaporizing portion 1', and the vapor pressure difference is controllable by the rate of the primary combustion air flow. Consequently the rate of vaporization of the fuel, namely the calorific value, is controllable by the primary combustion air flow.

Accordingly the combustion device of this invention is characterized in that the rate of vaporization of the liquid fuel is mainly controlled by the primary air supply to the gas phase adjacent the fuel vaporizing portion 1', the calorific value thus being controllable merely by adjusting the primary air flow. To realize this feature, the fuel supply must fulfil the following requirements:

(1) The fuel supply to the fuel vaporizing portion 1' must be in agreement with the calorific value (i.e. the rate of vaporization of the fuel at the portion 1') at all times despite variations in the calorific value, if any.

(2) The capacity to supply the fuel to the vaporizing portion 1' must permit a maximum calorific value at all times.

(3) The liquid fuel contained in the burner head 1 should not be allowed to overflow as into the primary combustion chamber 10 in any event.

(4) The minute channels of the burner head 1 must be free from dust, tar or like extraneous matter that would clog up the channels, resulting in a reduced fuel supply ability lower than is permissible.

The fuel vaporizing portion 1' needs to have the following properties for retaining the liquid fuel:

(1) High heat resistance but relatively low thermal conductivity.

(2) Large surface area to facilitate the vaporization of the liquid fuel.

Experiments have revealed that the burner head of the present device must have the following characteristics in order to meet the foregoing requirements.

(A) The burner head 1 is made of a porous material having extending therethrough minute channels which are predominently up to 100 μm in diameter as determined by a mercury porosimeter.

(B) The minute channels give the burner head 1 a porosity of at least 25%.

(C) The burner head is made of a heat-resistant material such as silica, silica alumina, alumina or the like.

(D) The burner head is capable of raising the liquid fuel at a rate of at least 0.001 g/cm$^2$·min to a height of up to 70 mm.

Figure 2:
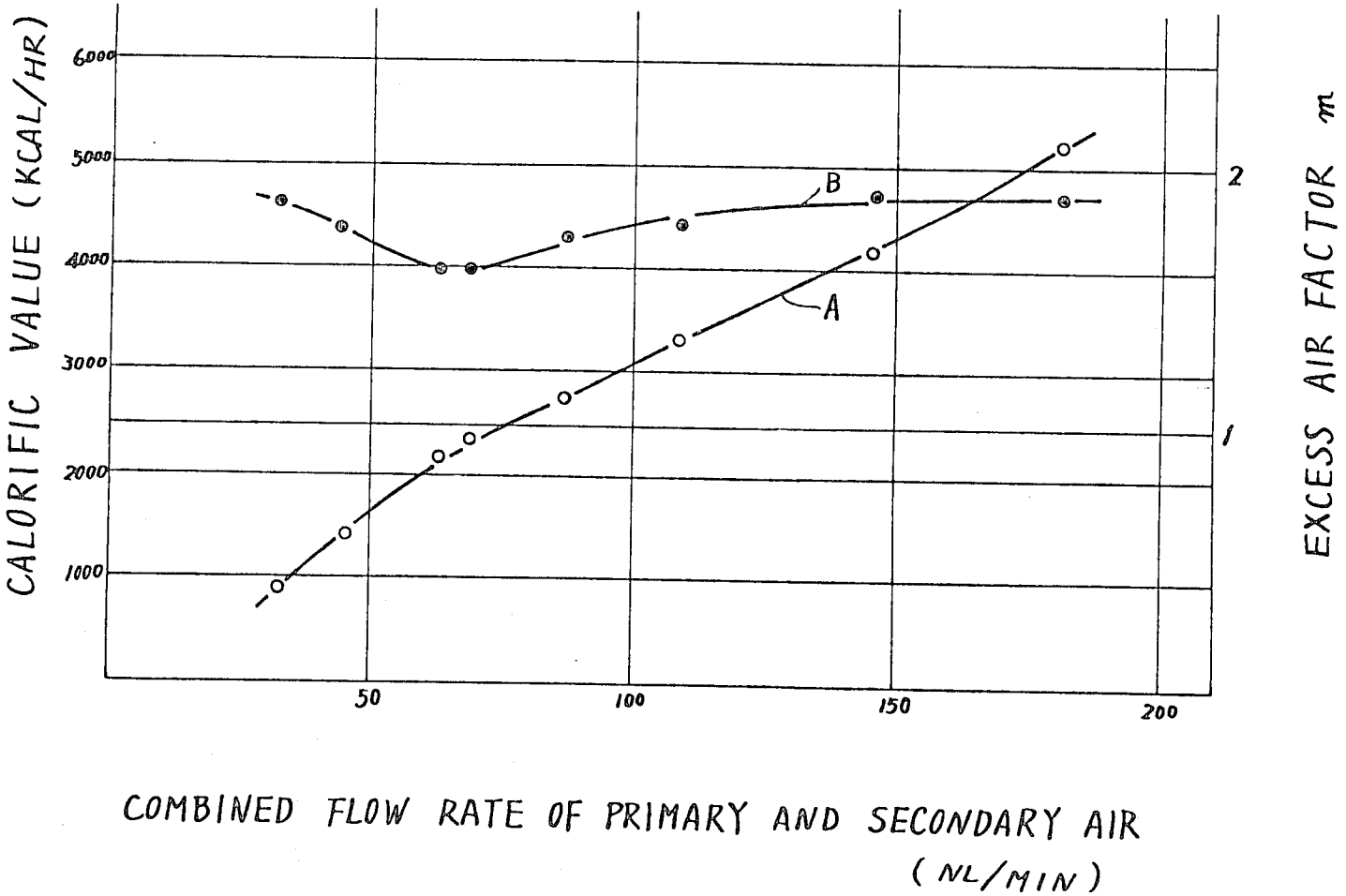
FIG. 2 is a graph showing the relation, established by the device of the invention, of the air flow rate to the calorific value and to the excess air factor.
Figure 3:
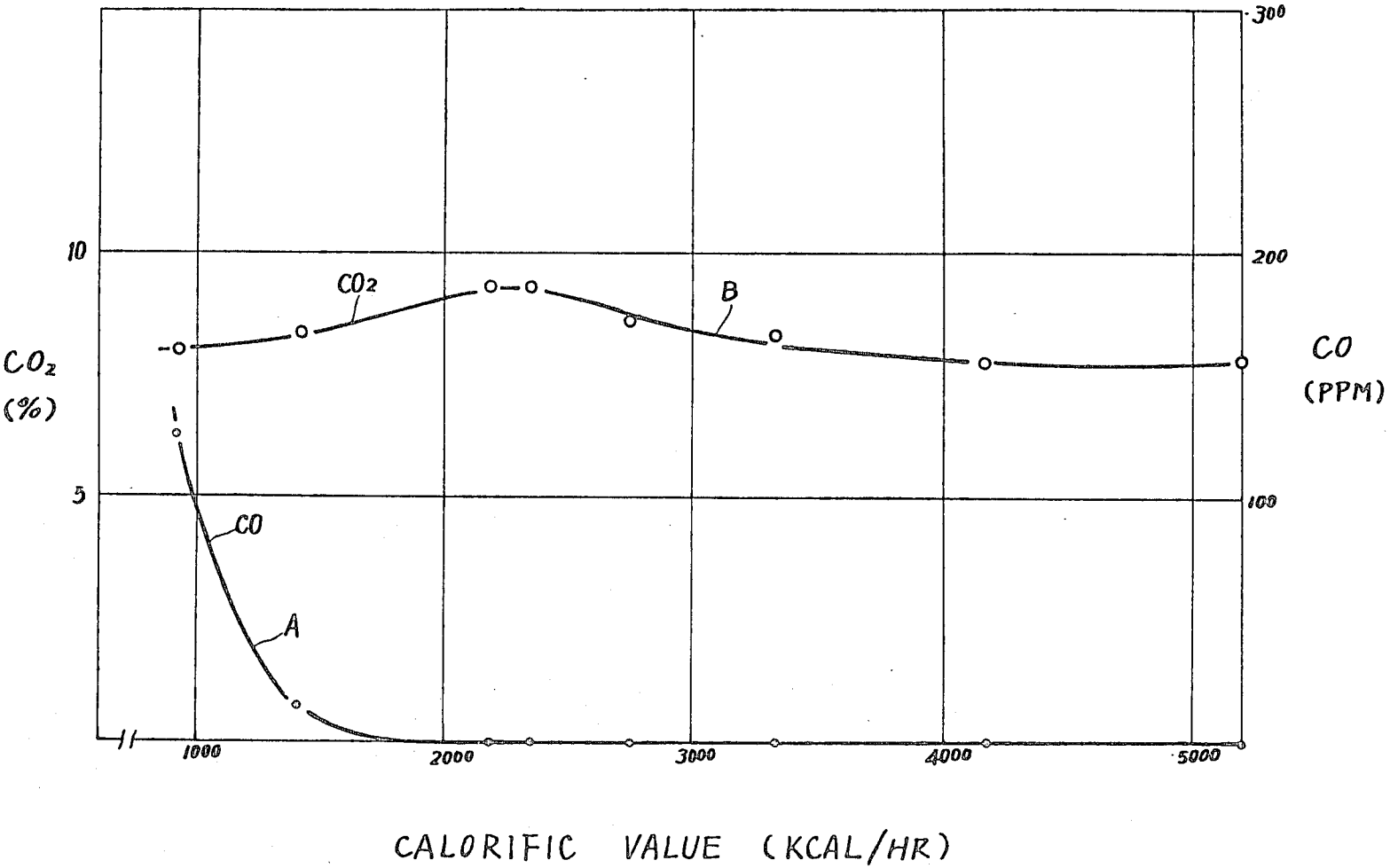
FIG. 3 is a graph showing the relation, involved in the present device, of the calorific value to the $CO_2$ and CO concentrations of the exhaust gas.

Since the primary combustion air flow and the secondary combustion air flow are both controlled at the same time, the ratio of the combined air flow to the rate of vaporization of the fuel is substantially constant even at varying calorific values, so that the carbon monoxide concentration of the exhaust gas can be maintained at a very low level despite variations in the calorific value. The burner head fulfilling the above requirements (A) to (D) and used in the combustion device shown in FIG. 1 exhibits the characteristics illustrated in FIGS. 2 and 3, in which FIG. 2 shows the relation of the air flow rate to the calorific value and to the excess air factor, and FIG. 3 shows the relation between the calorific value and the $CO_2$ and CO concentrations of the exhaust gas. With reference to FIG. 2, Line A indicates that the calorific value is approximately in proportion to the air flow rate, and Curve B shows that the excess air factor involved (represented by "m" in FIG. 2) is substantially constant. FIG. 3 reveals that the CO concentration of the exhaust gas is at a very low level over a wide range of calorific values as represented by Curve A, further showing that the $CO_2$ concentration remains at an approximately constant level as represented by Curve B. No soot occurs over the entire range of calorific values.

Thus according to this invention, the liquid fuel supply to the fuel vaporizing portion 1' is in agreement with the calorific value at all times even if the value varies, while the capacity to feed the fuel to the vaporizing portion 1' always permits a maximum of calorific value. Furthermore, the liquid fuel contained in the burner head 1 will in no way overflow into the combustion chamber. Consequently the calorific value is steplessly variable merely by altering the air supply to the fuel vaporizing portion 1', with the combustion sustained satisfactorily at all times.

In order to enable the fuel vaporizing portion 1' to exhibit the above characteristics over a prolonged period of time, the fuel vaporizing portion 1' must be made free from tarlike substances which would accumulate therein, hindering ignition and fuel supply. Additionally for the replacement or maintenance of the burner head 1 that may be desired, the burner head 1 must be detachable from the other part of the device.

When fuels are not stored under appropriate conditions, tarlike substances will be formed in the fuel during storage, and such substances may accumulate in the fuel vaporizing portion 1'. However, most of the tarlike deposits in the vaporizing portion 1' are high-boiling point substances resulting from partial degradation of the fuel at the portion 1'. Such substances, when formed, will gain in molecular weight with the lapse of time, change into higher-boiling point substances, release hydrogen and become coke-like substances having a high carbon content. Such conversion of the fuel appears attributable to condensation via oxidation.

In view of these phenomena, we carried out various experiments and found that the formation of tarlike substances can be inhibited with the use of a specific solid in the site of the conversion of the fuel to condensation products by way of oxidation, the solid consisting predominantly of at least one substance selected from the group consisting of silica alumina, alumina, magnesia silica, zeolite, magnesia and nickel oxide. In fact, we found the solid useful for the fuel vaporizing portion 1'. The experiments will be described below with reference to Table 1 which shows examples of refractory solids used for the vaporizing portion 1' conjointly therewith and the quantities of tarlike substances then formed. The quantity of tar listed is expressed in the ratio in percentage of the peak area of tar on a gas chromatogram to the combined peak area of tar and kerosene thereon. The value can be interpreted to approximately correspond to the weight of the tar formed. Although many other solid specimens were tested which, like copper-type substances such as copper oxide, permitted formation of larger amount of tar than conventional solids the results for such specimens are not listed. The solid was used in the form of particles or fine grains granulated from particles. Substantially the same result will be achieved when the solid is used in the form of a porous shaped body. The solid may be used on a shaped burner head, or shaped integrally with the burner head, or made into the burner head per se.

TABLE 1

| Refractory solid | | Amount of tar |
|---|---|---|
| Type | Component | |
| (Usual) | 20% Staple fiber, 80% borosilicate glass | 4.086 |
| Silica-alumina | (1) 85–90% $SiO_2$, 2–5% $Al_2O_3$, CaO $Na_2O$, $K_2O$ | 3.942 |
| Silica-alumina | (2) 73–54% $SiO_2$, 8–13% $Al_2O_3$, $Fe_2O^2$, MgO | 1.830 |
| Silica-alumina | (3) 49.3% $SiO_2$, 50.1% $Al_2O_3$ | 2.911 |
| Silica-alumina | (4) 48% $SiO_2$, 52% $Al_2O_3$ | 0.199 |
| Silica-alumina | (5) 37.1% $SiO_2$, 62.9% $Al_2O_3$, $TiO_2$, $Fe^2O_3$, CaO | 3.473 |
| Silica-alumina | (6) 84.1% $SiO_2$, 15.9% $Al_2O_3$ (surface area:400 m$^2$g) | 0.264 |
| Silica-alumina | (7) Same as above except for an increased grain size (surface area:540 m$^2$g) | 0.225 |
| Silica-alumina | (8) Same as (6) (surface area:450 m$^2$g) | 0.219 |
| Silica-alumina | (9) Same as (7) (surface area:600 m$^2$g) | 0.160 |
| Silica- | (10) 12% $SiO_2$, 88% $Al_2O_3$ | 0.197 |

TABLE 1-continued

| Refractory solid | | | Amount of tar |
|---|---|---|---|
| Type | | Component | |
| alumina | | | |
| Alumina | (1) | Dehydrated $Al_2O_3 \cdot xH_2O$ (surface area:160 $m^2g$) | 0.112 |
| Alumina | (2) | Same as above except for an increased grain size (surface area:110 $m^2g$) | 0.123 |
| Alumina | (3) | 94.1% $Al_2O_3$ | 0.072 |
| Magnesia-silica | (1) | 18.2% MgO, 81.8% $SiO_2$ (surface area:120 $m^2g$) | 0.126 |
| Magnesia-silica | (2) | Same as above except for an increased grain size (surface area:120 $m^2g$) | 0.139 |
| Nickel oxide | (1) | MgO, NiO | 2.542 |
| Nickel oxide | (2) | $Al_2O_3$, NiO | 2.482 |
| Nickel oxide | (3) | $SiO_2$, $Al_2O_3$, NiO | 2.708 |
| Zeolite | (1) | $CaAl_2Si_{10}O_{24} \cdot 7H_2O$ (H activity) | 0.499 |
| Zeolite | (2) | $Na_2O \cdot Al_2O_3 \cdot 9.3SiO_{O2}$ | 0.270 |
| Zeolite | (3) | $\frac{1}{4}Na_2O \cdot \frac{3}{4}K_2O \cdot Al_2O_3 \cdot 2SiO_2 \cdot xH_2O$ | 2.529 |
| Zeolite | (4) | $\frac{1}{3}Na_2O \cdot \frac{2}{3}K_2O \cdot Al_2O_3 \cdot 2SiO_2 \cdot xH_2O$ | 2.988 |
| Zeolite | (5) | $Na_{86}(AlO_2)_{86}(SiO_2)_{106} \cdot 276H_2O$ | 0.031 |
| Zeolite | (6) | $(Na,K)_2CaAl_4Si_{20}O_{48} \cdot 14H_2O$ | 0.071 |

Note:
The surface area given includes the outer surface areas of grains and also areas of surfaces defining pores within the grains.

Table 1 reveals that the formation of tar can be greatly inhibited by the use of a selected solid conjointly with the fuel vaporizing portion 1'.

The embodiment described above, in which the fuel vaporizing portion 1' is less susceptible to the deposition of tarlike substances, operates with a high combustion efficiency without producing a large amount of soot or carbon monoxide or giving off a noxious odor. Being free from tarlike deposits, the present device is easily ignitable at all times, while the means provided to preclude various objections heretofore experienced will not render the device costly.

While the present embodiment has been described above specifically with reference to the burner head 1, the mode of combustion is dependent heavily on the factor which is determined by the shape and construction of the head and primary combustion chamber and by other conditions involved, namely on the stoichiometric ratio in equivalent of the rate of the primary air flow to the rate of vaporization of the fuel. The relation between the equivalent ratio and combustion will now be described.

Figure 4:
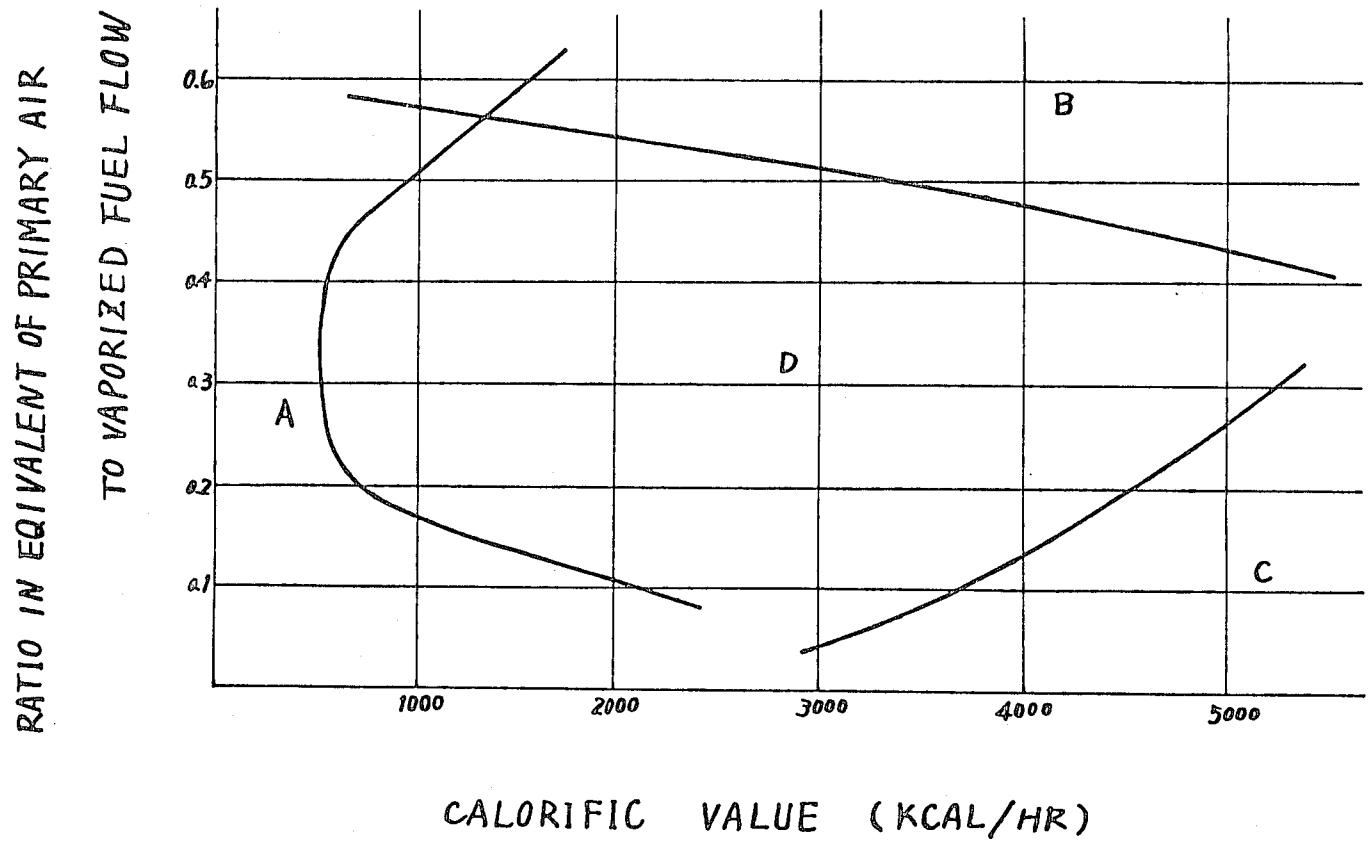
FIG. 4 is a graph showing the relation, involved in the present device, of the calorific value to the ratio in equivalent of the primary air flow rate to the quantity of vaporized fuel.

FIG. 4 shows the influence of the equivalent ratio on various characteristics at varying calorific values. Indicated at A is a region in which the carbon monoxide concentration of the exhaust gas exceeds 100 ppm. In a region B, combustion entails many yellow flames and gives off soot with an unstable relation between the air flow rate and calorific value. Designated at C is a region in which the calorific values concerned are not achievable owing to insufficient vaporization of the fuel when the pressure difference between the air chambers 7 and the secondary combustion chamber 11 is up to 10 mm Aq. When the pressure difference is up to 10 mm Aq. the fuel can be burned in a region D with clean blue flames, without producing any soot and with the carbon monoxide concentration limited to 100 ppm if highest. To sum up, it is seen that when the stoichiometric ratio in equivalent of the rate of the primary air flow to the rate of vaporization of the fuel is set within the range of 0.1 to 0.5, the device gives a steplessly variable calorific value over a wide range while ensuring steady combustion and releasing a clean exhaust gas.

Figure 5:
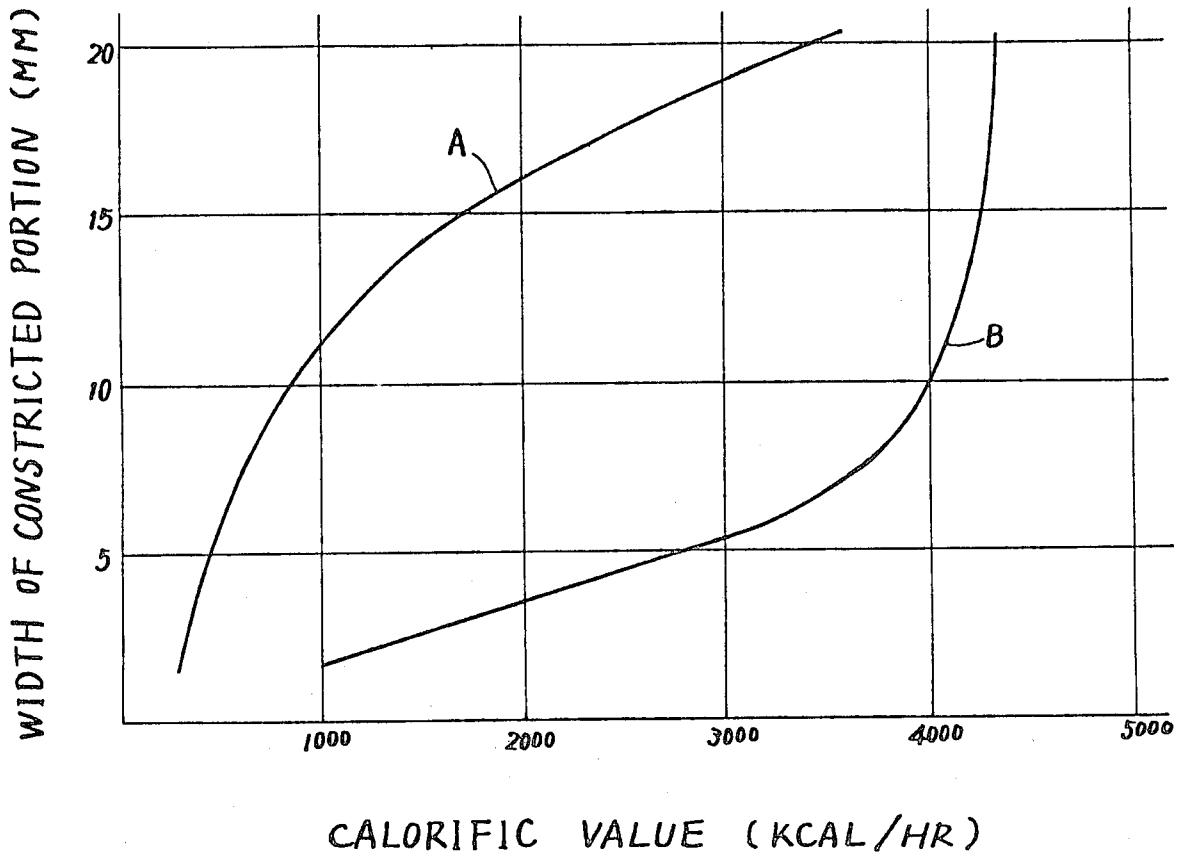
FIG. 5 is a diagram showing the effect produced by a constricted portion provided between the primary combustion chamber and secondary combustion chamber of the present device.

The constricted portion 12 of the device of FIG. 1 at the boundary between the chambers 10 and 11 produces the following effects. The constricted portion 12 permits improved mixture between the fuel vapor and the secondary air especially at low calorific values. With an increase in the width (indicated at A in FIG. 1) of the constricted portion 12, the combustion efficiency at low calorific values reduces and the exhaust gas becomes less clean. Preferably the constricted portion 12 has a width of up to about 16 mm, whereas as the width A of the constricted portion 12 decreases, the maximum calorific value per unit length of the overall combustion chamber in its longitudinal direction lowers, thus necessitating a longer combustion chamber to obtain the desired maximum calorific value, hence uneconomical. FIG. 5 shows variations in the calorific value with the width of the constricted portion when the overall combustion chamber has a length of 100 cm. Curve A represents calorific values when the carbon monoxide concentration of the exhaust gas is in excess of 100 ppm. Curve B shows calorific values when the pressure difference between the air chambers 7 and the secondary combustion chamber 11 is 10 mm Aq. The graph reveals that the constricted portion 12 should most preferably have a width of about 9 mm since the larger the distance between the Curves A and B, the higher are the characteristics. Widths larger than 18 mm appear unsuited for use. The constricted portion, when having a very small width, is uneconomical but nevertheless will be usable for special application where low calorific values are desired.

Preferably the opposed side walls formed with the secondary combustion air passages 9 extend downstream from the constricted portion 12 outward away from each other at an angle. When the opposed walls are in parallel to each other, the secondary air flow forms an air curtain which will materially impede the flow of fluid from the primary combustion chamber 10 to the secondary combustion chamber 11. The above-mentioned angle, indicated at B in FIG. 1, is preferably about 80 degrees although slightly variable with the flow rate of the secondary air.

The secondary combustion air passages 9 opened to the secondary combustion chamber 11, when arranged as opposed to each other, will cause the opposed secondary air flows to strike each other, with the resulting likelihood that yellow flames will be formed to produce soot. Preferably, therefore, the passages 9 are provided as displaced from each other.

What we claim is:

1. A combustion device for a liquid fuel comprising a burner head capable of containing the liquid fuel in a liquid state, means for feeding the liquid fuel to the burner head, a fuel vaporizing portion for vaporizing the fuel fed to the burner head, a combustion chamber for burning the fuel released from the vaporizing portion upon vaporizing, means for supplying air to the vaporizing portion and to the combustion chamber, and means for regulating the flow of air to be supplied from the air supplying means, the burner head being made of a heat-resistant porous material having extending therethrough minute channels predominantly up to 100 μm in diameter and giving the burner head a porosity of at least 25%, the burner head being capable of raising the liquid fuel at a rate of at least 0.001 g/cm$^1$·min to a height of up to 70 mm.

2. A combustion device as defined in claim 1 wherein at least the vaporizing portion of the burner head is made of a material predominantly containing at least one substance selected from the group consisting of silica alumina, alumina, magnesia silica, zeolite, magnesia and nickel oxide.

3. A combustion device as defined in claim 1 wherein the combustion chamber comprises a primary combustion chamber accommodating the vaporizing portion and a secondary combustion chamber provided downstream from the primary combustion chamber.

4. A combustion device as defined in claim 3 wherein the burner head and the primary combustion chamber are so designed that the stoichiometric ratio in equivalent of the rate of the air supply to the primary combustion chamber to the rate of vaporization of the fuel from the vaporizing portion is in the range of 0.1 to 0.5.

5. A combustion device as defined in claim 3 wherein means is provided downstream from the flow regulating means for dividing the air flow into the air to be supplied to the primary combustion chamber and the air to be supplied to the secondary combustion chamber.

6. A combustion device as defined in claim 5 wherein the dividing means comprises a plurality of ports formed in a wall defining the primary combustion chamber and a plurality of ports formed in a wall defining the secondary combustion chamber.

7. A combustion device as defined in claim 3 wherein a constricted portion is provided at the boundary between the primary combustion chamber and the secondary combustion chamber.

8. A combustion device as defined in claim 7 wherein the constricted portion has a width of up to 18 mm.

9. A combustion device as defined in claim 7 wherein a plurality of ports for introducing the air into the secondary combustion chamber are formed in each of a pair of walls defining the secondary combustion chamber, the pair of walls extending downstream away from each other at an angle in opposed relation.

10. A combustion device as defined in claim 9 wherein the angle is about 80 degrees.

11. A combustion device as defined in claim 9 wherein the ports formed in one of the walls are arranged as displaced from the ports formed in the other wall.

* * * * *

UNITED STATES PATENT AND TRADEMARK OFFICE

CERTIFICATE OF CORRECTION

PATENT NO. : 4,229,159

DATED : October 21, 1980

INVENTOR(S) : YOSHIMI OHMUKAI ET AL

It is certified that error appears in the above—identified patent and that said Letters Patent is hereby corrected as shown below:

Title page, under "[75] Inventors:" "Hirakata" should read -- Osaka --; "Katana" should read -- Osaka --; "Nara" should read -- Nara-ken --.

Title page, under "[30] Foreign Application Priority Data", second priority document "53/1022643" should read -- 53/022643 --.

After the Abstract, "No Drawings" should read -- 5 Drawing Figures --.

Column 6, line 61, "upon vaporizing" should read -- upon vaporization --.

Column 7, line 1, "$g/cm^1$" should read -- $g/cm^2$ --.

Signed and Sealed this

*Twenty-fourth* Day of *March 1981*

[SEAL]

*Attest:*

RENE D. TEGTMEYER

*Attesting Officer*

*Acting Commissioner of Patents and Trademarks*